United States Patent [19]

Johnson et al.

[11] Patent Number: 4,909,351

[45] Date of Patent: Mar. 20, 1990

[54] PLATFORM ATTACHMENT FOR A LADDER

[76] Inventors: Charles E. Johnson, 3322 W. 97th St., Evergreen Park, Ill. 60642; Joseph D. Radzevich, 12422 S. Harold, Palos Heights, Ill. 60463

[21] Appl. No.: 380,867

[22] Filed: Jul. 17, 1989

[51] Int. Cl.[4] ..... E06C 7/16

[52] U.S. Cl. ..... 182/121; 182/83

[58] Field of Search ..... 182/121, 122, 83

[56] References Cited

U.S. PATENT DOCUMENTS

| | | | |
|---|---|---|---|
| 279,347 | 6/1883 | Burns | 182/83 |
| 407,079 | 7/1889 | Laskey . | |
| 812,620 | 2/1906 | Alstine | 182/121 |
| 1,943,626 | 1/1934 | Richard | 182/121 |
| 2,104,987 | 1/1938 | Harding . | |
| 2,174,891 | 10/1939 | Maran . | |
| 2,415,289 | 2/1947 | Jury . | |
| 2,709,626 | 5/1955 | Woodburn | 182/121 |
| 3,044,572 | 7/1962 | Thomas | 182/83 |
| 3,331,577 | 7/1967 | Grunwaldt . | |
| 3,552,523 | 1/1971 | Berkely . | |
| 4,482,030 | 11/1984 | Lincourt . | |

FOREIGN PATENT DOCUMENTS

| | | |
|---|---|---|
| 2610264 | 9/1977 | Fed. Rep. of Germany . |
| 132835 | 7/1929 | Switzerland . |
| 1512155 | 5/1978 | United Kingdom . |
| 2036152 | 6/1980 | United Kingdom . |

*Primary Examiner*—Reinaldo P. Machado
*Attorney, Agent, or Firm*—Gerlach & O'Brien

[57] ABSTRACT

A platform attachment for a ladder having a pair of spaced apart sidepieces connected together by a series of spaced apart rungs includes a pair of spaced apart slideways mounted on the ladder adjacent to respective sidepieces, and a platform extending between and supported on the slideways for sliding movement reciprocatively between a working position projecting forwardly from the ladder and an out-of-the-way position retracted rearwardly from the working position. Preferred mounting structure includes a bracket connected to the slideways and engaging a rung of the ladder above the slideways.

17 Claims, 2 Drawing Sheets

PLATFORM ATTACHMENT FOR A LADDER

BACKGROUND OF THE INVENTION

This invention relates to platform attachments for ladders, in particular, ladders having a pair of spaced apart sidepieces connected together by a series of spaced apart rungs. More particularly, the invention relates to attachments on which an individual may stand while working, or, alternatively, on which articles may be supported, if desired.

Heretofore, numerous platform attachments for ladders have been provided, for the purpose of supporting an individual working from the ladder and/or for the purpose of supporting articles on the ladder. A principal object of the attachments which support a user is to provide a relatively wide, stable platform on which the user may stand comfortably for various periods of time while working. The attachments may be mounted at different locations on the ladder, removed when not in use, and conveniently carried from place to place.

A problem that is encountered when attempting to provide a platform attachment on which one may stand comfortably is the difficulty in getting past and above the platform when climbing the ladder, owing to the outward projection of a substantial part of the platform. The projection of the platform is desirable for comfort and the ability to change position on the platform without the feet and legs being unduly restricted.

SUMMARY OF THE INVENTION

The invention provides a platform attachment for a ladder, designed especially for supporting an individual using the ladder while working, that accomplishes the objects described above for the prior attachments, and also solves the problem of climbing the ladder with the attachment in place, even though the platform of the attachment projects a substantial distance outwardly or forwardly from the front of the ladder when in use.

The invention provides a platform attachment that may be mounted on a ladder easily and quickly, and then enables the user to climb up the ladder and past the platform of the attachment, which is in an out-of-the-way retracted position, after which the platform may be moved to a working position by the user easily and safely, and the user may stand on the platform and commence working. The attachment is readily constructed as a relatively simple structure that is strong, durable, safe and reliable.

More particularly, the invention provides a platform attachment for a ladder having a pair of spaced apart sidepieces connected together by a series of spaced apart rungs, which attachment includes a pair of spaced apart slideways, means for mounting the slideways on the ladder adjacent to respective ones of the sidepieces, and a platform extending between the slideways and supported thereon for sliding movement reciprocatively between a working position projecting forwardly from the ladder and an out-of-the-way position retracted rearwardly from the working position.

The platform preferably is constructed and arranged for engagement by a free foot of a user who is supported by the remaining foot on a rung of the ladder above the slideways, whereby the user can slidably move the platform between the working and out-of-the-way positions with the free foot. An advantageous and further preferred structure includes an uneven normally upper surface on the platform adapted for frictional engagement with the user's free foot for effecting the movement of the platform.

In further preferred embodiments, the slideway mounting means include a bracket connected to the slideways and engaging a rung of the ladder above the slideway, further preferably including means for connecting the bracket to the slideways adjustably, to accommodate differing rung spacings. In still further preferred embodiments, the slideways seat on another rung of the ladder. Such rungs preferably are successive rungs of the ladder.

The invention includes a platform attachment accomplishing the foregoing objects and including the foregoing structural elements, alone and in combination with a ladder of the above description. While not so limited, the invention is especially desirable for use by persons working on building exteriors, high structures, and the like, including persons painting, cleaning, or repairing building, wall and structural surfaces, on single section or extension ladders, and as a substitute for or addition to scaffolding or other supporting structure.

BRIEF DESCRIPTION OF THE DRAWINGS

The drawings illustrate preferred embodiments of the invention, without limitation thereto. In the drawings, like elements are identified by like reference characters in each of the views.

DESCRIPTION OF THE PREFERRED EMBODIMENTS

Figure 1:
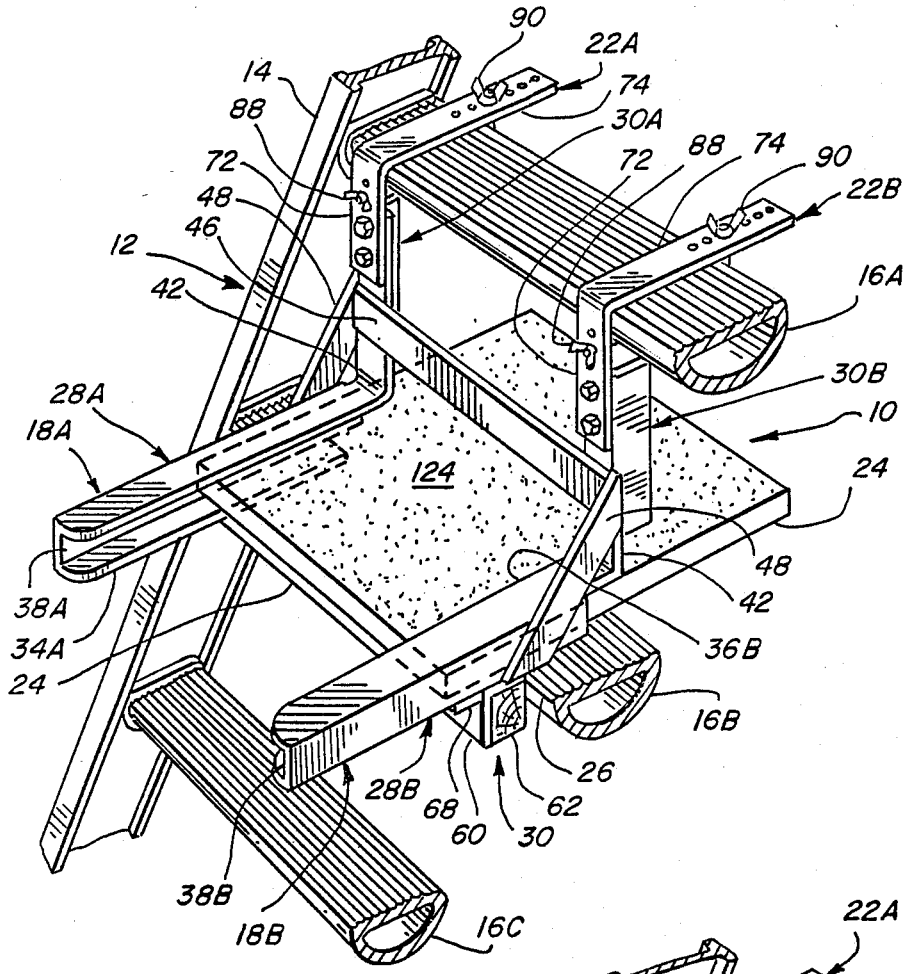
FIG. 1 is a perspective view of a preferred embodiment of the platform attachment, in accordance with the invention, illustrated as mounted on a ladder, shown fragmentarily, with a platform of the attachment in an out-of-the-way position.
Figure 2:
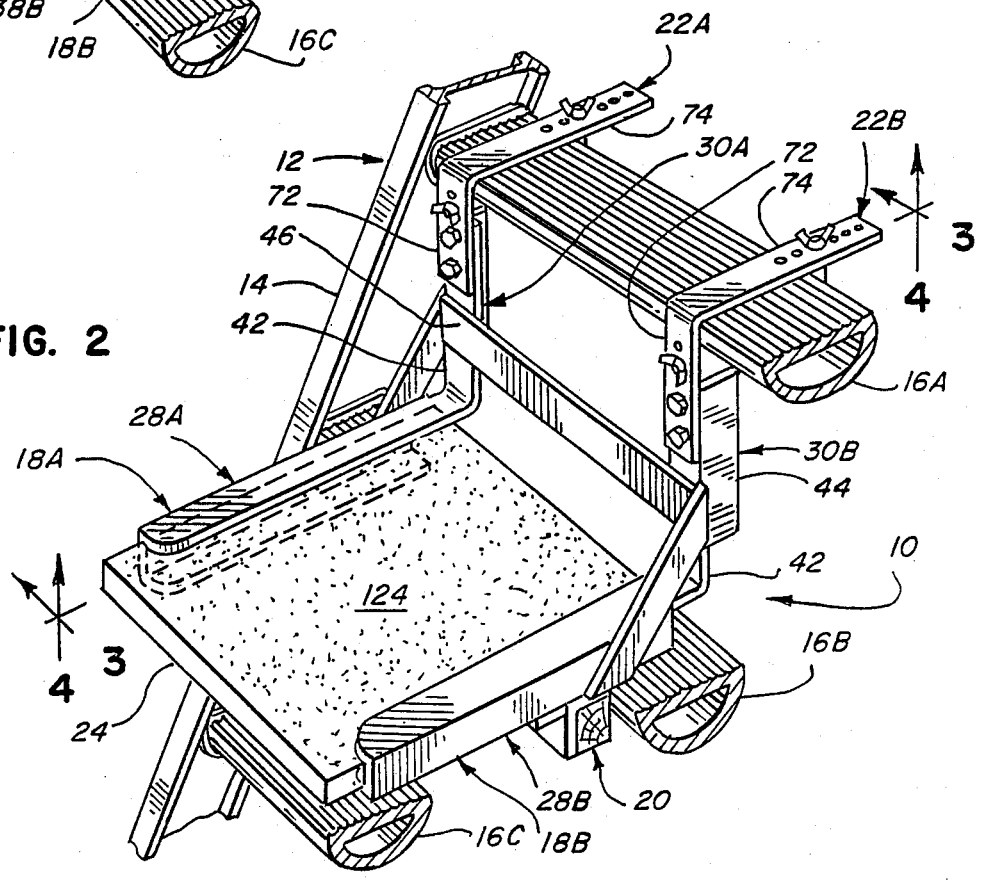
FIG. 2 is a view like FIG. 1 but illustrating the platform in a working position.
Figures 3, 4, 5, 6, 7, 8:
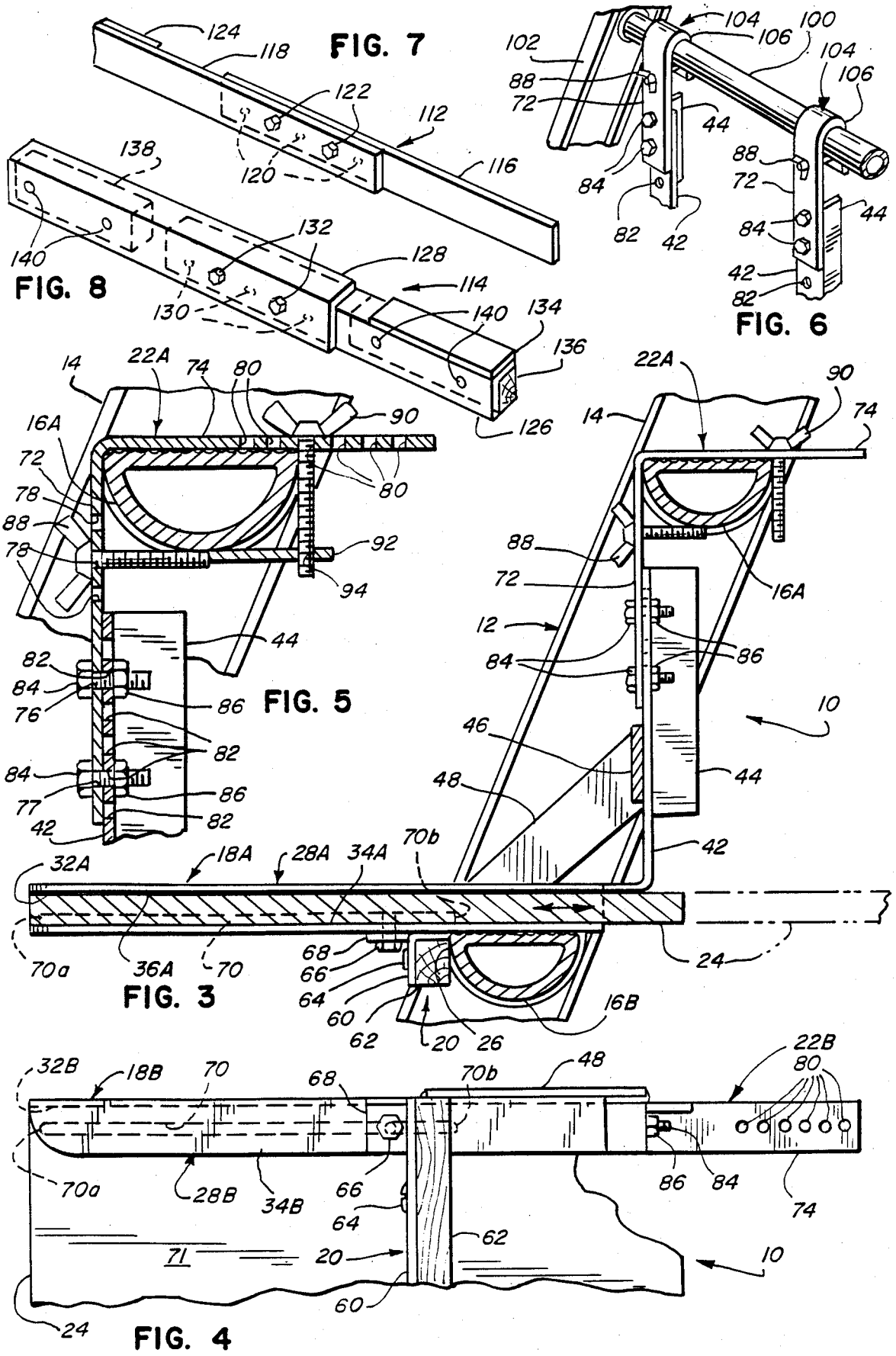
FIG. 3 is an enlarged longitudinal sectional view of the platform attachment mounted on the ladder, taken substantially on line 3—3 of FIG. 2.
FIG. 4 is a similarly enlarged fragmentary bottom plan view of the attachment, taken substantially on line 4—4 of FIG. 2.
FIG. 5 is a further enlarged fragmentary longitudinal sectional view of the attachment structure illustrated in FIG. 3.
FIG. 6 is a fragmentary perspective view of another preferred embodiment of the platform attachment, in accordance with the invention, illustrated as mounted on another type of ladder, which is shown fragmentarily, showing a second embodiment of means for mounting the attachment on the ladder.
FIG. 7 is an enlarged perspective view of an adjustable crosspiece, which may be employed alternatively in the structures of FIGS. 1–6.
FIG. 8 is an enlarged perspective view of an adjustable abutment, which may be employed alternatively in the structures of FIGS. 1–6.

Referring to FIGS. 1–3 of the drawings, a platform attachment 10 is illustrated as mounted on a ladder 12 of the generally flat-rung type. The ladder 12 is a conventional structure of a pair of spaced apart, generally parallel sidepieces or elements 14, one of which is illustrated, connected together by a series of spaced apart rungs, crosspieces or steps 16A, 16B, and 16C. Three successive rungs are illustrated, and they include a pair of rungs 16A and 16B, on which the attachment 10 is mounted, and a rung 16C that immediately precedes the pair of rungs 16A and 16B in the order of ascendancy on the ladder.

The ladder 12 selected for illustrating the invention is one of a number of generally flat-rung ladders with which the attachment 10 may be employed in combination, including ladders of different materials of construction, such as wood and metal, and ladders differently constructed for erecting them in use, such as single section ladders and multi-sectional, particularly extension, ladders. The attachment 10 is especially adapted for use with any of such ladders, which may have varying rung spacings and may be erected at varying angles from vertical. The platform attachment 10 is mountable on any one of plurality of pairs of successive rungs of the ladder, illustrated by the pair of rungs 16A and 16B.

The attachment 10 is constructed of a pair of spaced apart slideways 18A and 18B, an abutment 20 connected to the slideways, a pair of spaced apart brackets 22A and 22B connected to the slideways, and a platform 24 extending between and supported on the slideways. As mounted on the ladder 12, the slideways 18A and 18B are seated on the lower rung 16B of the pair of rungs 16A and 16B, with the slideways disposed adjacent to respective ones of the ladder sidepieces 14. The brackets 22A and 22B are connected directly to the slideways 18A and 18B, respectively, in longitudinal alignment therewith. The brackets engage the upper rung 16A of the pair of rungs 16A and 16B, for mounting the attachment 10, particularly the slideways 18A and 18B thereof, on the ladder 12.

In the preferred assembly with a ladder, such as the ladder 12, the abutment 20 abuts on the front edge 26 of the lower rung 16B of the pair of rungs 16A and 16B, thereby to locate and align the slideways 18A and 18B with respect to the ladder. The platform 24 is supported for sliding movement on the slideways 18A and 18B, reciprocatively between a working position projecting forwardly from the ladder and an out-of-the-way position retracted rearwardly from the working position. Illustrative working positions are shown in FIGS. 2–4. In FIG. 2, the platform 24 is fully extended forwardly, and in FIGS. 3 and 4, the platform is extended a lesser distance. An out-of-the-way position is illustrated in FIG. 1.

More specifically, and referring to FIGS. 1–4, each of the slideways 18A and 18B is a one-piece structure of a slide proper 28A or 28B, and a riser or connector 30A or 30B, respectively. The slideways 18A and 18B are mirror images of each other, and the slides 28A and 28B are generally U-shaped channel members each having a channel 32A or 32B (FIGS. 3 and 4) that extends longitudinally of its slideway 18A or 18B. The channels 32A and 32B are defined by lower flanges 34A and 34B (FIGS. 3 and 4), upper flanges 36A and 36B (FIGS. 1 and 3) and webs 38A and 38B (FIG. 1), respectively, the webs being joined integrally to the upper and lower flanges along opposite longitudinal edges of the webs. As illustrated in FIG. 4, each of the flanges 34A, 34B, and 36A, 36B is provided with a rounded or curved inside corner 40 at its forward or leading end, for reasons which will appear.

As illustrated for one riser 30A in FIG. 3, each of the risers 30A and 30B is constructed of an upright 42 and a reinforcement 44 forming an angle bar therewith. The normally lower end of each upright 42 in the illustrative embodiment is continuous with and bent perpendicularly to the upper flange 36A or 36B of the slide 28A or 28B of its slideway 18A or 18B. The several components of the illustrative slideways may be joined together in various ways, such as by forming unitarily with others components or by welding, and are made of material having suitable strength characteristics, such as steel.

The slideways 18A and 18B are joined together by the abutment 20, rigidly connected to the slides 28A and 28B, and a crosspiece or crossbar 46, rigidly connected to the risers 30A and 30B. A strong, rigid attachment frame is completed by a pair of corner braces or gussets 48, each rigidly connected, as by welding, to the web 38A or 38B and the riser 30A or 30B of a slideway 18A or 18B. The crosspiece 46 and braces 48 preferably are constructed of steel. The side edges of the platform 24 are received in the slide channels 32A and 32B and seat on the lower flanges 34A and 34B, for sliding movement on such flanges.

The abutment 20 is constructed of an angle member or bar 60, of steel or other suitable strength material, and a bumper 62 of lesser hardness, such as wood, secured together along the length of the angle member by suitable means, such as screws 64. The angle member is rigidly secured at its opposite ends to the lower flanges 34A and 34B of the slides 28A and 28B, by suitable means, such as welding. The crosspiece 46 is secured at its opposite end to the uprights 42 of the risers 30A and 30B, respectively, by suitable means, such as welding.

As seen in FIGS. 3 and 4, a stop bolt 66 extends through a reinforcing base or plate 68 fixedly secured to the lower flange 34A or 34B of each slide 28A and 28B, in threaded engagement with the base 68, adjacent to the front side of the abutment 20. Each stop bolt 66 also extends through a lower flange 34A or 34B and projects into the channel 32A or 32B of a slide. The platform 24 is provided with a longitudinal groove 70 in its lower surface 71 that faces the lower flange 34A or 34B of each of the slides 28A and 28B, to receive a stop bolt 66 in each groove. The opposite longitudinal ends **70*a*, 70*b* of each groove 70 are closed, and the closed ends serve as stops for engagement with the stop bolts 66**.

As will be seen upon examination of FIGS. 3 and 4, the platform 24 may be moved longitudinally in the slides 28A and 28B, between limits determined by engagement of the bolts 66 with the opposite ends **70*a* and 70*b* of the slots 70, while the platform remains captive in the slides. In this manner, the platform 24 may be moved in sliding motion on the lower flanges 34A and 34B, between a working position projecting forwardly from the ladder, such as illustrated in full lines in FIGS. 2–4, and an out-of-the-way position retracted rearwardly from the working position, such as illustrated in FIG. 1**.

When fully projected, the platform 24 may project forwardly beyond the slides 28A and 28B, for a short distance as seen in FIG. 2. A user may be supported while standing with both feet on the platform, and, if desired, standing completely outboard of the rung 16B on which the slideways 18A and 18B are supported. The platform 24 may be retracted to a position in which it projects only a small distance forwardly from the rung 16B, as seen in FIG. 1, while a major portion of the length of the platform extends rearwardly beyond the rung 16B, in the illustrative embodiment.

The platform 24 when retracted presents no obstacle to ascending or descending the ladder. The slideways 18A and 18B, and likewise the brackets 22A and 22B, are spaced apart sufficiently to permit the user to ascend or descend the ladder when the platform 24 is retracted, with the user's legs moving between the slideways and enabling him to stand on the upper rung 16A, where both feet may be supported on the rung between the brackets 22A and 22B, easily, safely, and rapidly.

In the embodiment of FIGS. 1–5, the brackets 22A and 22B each comprise a flat, preferably steel bar bent at a right angle, to form a connecting leg 72 and an engagement leg 74. The legs 72 and 74, in normal use with the ladder erected, extend generally vertically and generally horizontally, respectively. Each connecting leg 72 is provided with two spaced apart connecting openings 76, 77 (see FIG. 5), in its outer or lower portion, and three threaded mounting openings 78 in its inner or upper portion, relatively closely spaced from the engagement leg 74. The engagement leg 74 is provided with a row of spaced apart threaded mounting openings 80 in its outer or rear portion.

The connecting openings 76, 77 of each connecting leg 72 are disposed for registry with a selected pair of like connecting openings 82 provided in a row of spaced apart openings in the upper or outer portion of an adjacent riser upright 42 (See FIG. 5). Each connecting leg 72 is connected to the adjacent riser 30A or 30B of a slideway 18A or 18B by means of connecting bolts 84 inserted through the connecting openings 76, 77 in the leg 72 and aligned connecting openings 82 in the adjacent riser upright 42, and secured by connecting nuts 86 threaded on the bolts 84. The several openings and the bolts and nuts provide means for connecting the brackets 22A and 22B to the slideways 18A and 18B, adjustably to accommodate different spacings between the rungs 16A and 16B. Thus, the openings 76, 77 in each connecting leg 72 are adjusted longitudinally relative to a riser upright 42, to match with a pair of upright connecting openings 82 selected to provide the desired spacing or vertical distance between the slides 28A and 28B, and the engagement legs 74 of respective brackets 22A and 22B.

With the brackets 22A and 22B connected to the slideways 18A and 18B in this manner, respective brackets and slideways are aligned longitudinally in the attachment 10, and each combination of bracket and slideway is substantially parallel to the other, with the spacing between the slides 28A and 28B substantially the same as the spacing between the brackets 22A and 22B. The spacing preferably is selected both to provide for a wide platform on which to stand and to provide a maximum of space for the user's legs to move between the spaced members, and also so as to enable the slideways and brackets to fit between the sidepieces 14 of ladders having varying widths. For example, the spacing between the slides 28A and 28B, and also between the brackets 22A and 22B, may be about 10 to 11 inches, in one embodiment. The foregoing spacing may be made variable, however, by providing means for adjusting the length of an abutment similar to the abutment 20, and means for adjusting the length of a crosspiece similar to the crosspiece 46. Such means are exemplified in FIGS. 7 and 8, as described hereinafter.

The engagement legs 74 are adapted to seat on flat or relatively flat rungs, such as the illustrative upper rung 16A, to engage the rung for mounting the attachment 10 on the ladder 12. Engagement wing bolts 88 and 90, threaded through the mounting openings 78 and 80, respectively, serve to further engage the rung 16A. One bolt 88 extends generally horizontally through a selected one of the mounting openings 78, beneath and relatively close to the rung 16A. The other bolt 90 extends generally vertically through a selected one of the mounting openings 80, relatively close to the rear edge of the rung 16A. The engagement bolts 88 and 90, preferably constructed of high strength steel, serve to secure the attachment 10 in a substantially set position on the ladder 12, and prevent rotation of the attachment 10 about a horizontal axis when a load is placed on the cantilevered platform 24. At this time, one or both of the shanks of the bolts 88 and 90 in each bracket 22A and 22B engage the rung 16A to prevent the brackets 22A and 22B from being pulled off of or becoming disengaged from the rung 16A.

It will be understood that additional or different means may be employed with the brackets 22A and 22B for engagement with the upper rung 16A. For example, as illustrated in FIG. 5, a relatively small plate or bar 92, having a threaded opening 94, may be threaded onto the outer end of each vertically disposed engagement bolt 90, and generally snugged up against the bottom of the rung 16A, so as to provide an additional restraint preventing the bracket from pulling away from the rung.

FIG. 6 illustrates another embodiment of a mounting bracket, for use in mounting a platform attachment of the invention on a ladder having, instead of generally flat rungs 16A–C, round or cylindrical rungs 100, extending between and secured to spaced parallel ladder sidepieces 102. Alternatively, the ladder may have rounded rungs (not shown) that have flat upper surfaces, as employed in another popular structure. Mounting brackets 104 are provided that are similar to the brackets 22A and 22B of the first embodiment, except that the engagement legs 74 of the first embodiment are replaced by inverted generally U-shaped engagement legs 106, preferably constructed of steel. The remaining structure of the platform attachment may be essentially the same.

The brackets 104 are connected adjustably to the uprights 42 of the risers 30A and 30B by connecting bolts 84, as in the first embodiment. With the engagement legs 106 seated on the rung 100, an engagement wing bolt 88 is threaded through a tapped opening in each connecting leg 72, to project beneath the rung 100 and thereby prevent removal of the brackets 104 from the rung.

FIGS. 7 and 8 illustrate structure for varying the width and spacings of either of the foregoing embodiments of the platform attachment. FIG. 7 illustrates a crosspiece 112 that is adjustable in length, which may be provided in place of the fixed or constant length crosspiece 46. FIG. 8 illustrates an abutment 114 that is adjustable in length, which may be provided in place of the fixed or constant length abutment 20.

As noted above, the adjustable structure may be provided to enable the user to conform the attachment to different spacings of the sidepieces 14, in particular, to space apart the slides 28A and 28B, and the brackets 22A and 22B, or the brackets 104, as far as possible within the confines of the sidepieces 14. Depending upon the amount of variation in spacing, it may be necessary or advisable to provide also platforms 24 of different widths, or to provide a platform of adjustable width.

The crosspiece 112 includes overlapping inner and outer flat bars 116 and 118. The inner bar 116 is provided with a series of bolt holes 120, and the outer bar 118 is provided with a pair of bolt holes through which bolts 122 are inserted. The bolts also are inserted through a registering pair of inner bar holes 120, and are secured by nuts (not shown), which holes are selected to provide a desired length of the crosspiece 112 and corresponding width of the attachment. A spacer 124 is fixed to the inner surface of the outer bar 118 at its free end, to level the bar for attachment purposes. The spacer and the free end of the inner bar 116 are secured fixedly to the riser uprights 42, by suitable means, such as welding.

The abutment 114 includes telescoping inner and outer angle bars 126 and 128. One flange of the inner bar 126 is provided with a series of bolt holes 130, and an overlapping flange of the outer bar 128 is provided with a pair of bolt holes through which bolts 132 are inserted. The bolts also are inserted through a registering pair of inner bar holes 130, and are secured by nuts (not shown), which holes are selected to provide a desired length of the abutment 114 and corresponding width of the attachment.

A spacer 134 is fixed to the outer surface of the remaining flange of the inner bar 126 at its free end, to level the bar for attachment purposes. The spacer 134 and the free end of the remaining flange of the outer bar 128 are secured fixedly to the lower slide flanges 34A and 34B, respectively, by suitable means, such as welding. Bumpers 136 and 138 in the form of wood blocks are secured within the angle bars 126 and 128, respectively, at their free ends, by screws 140 inserted through a flange of each bar.

The attachment 10 is constructed for mounting it on a ladder, such as the ladder 12, by carrying it up the ladder and mounting it on successive rungs at a location at which the user intends to stand when working. It may be mounted on a ladder having one or more sections. Before mounting, the positions of the brackets 22A and 22B relative to the risers 30A and 30B is determined according to the spacing between successive rungs 16A and 16B. The connecting legs 72 of the brackets are adjusted relative to the riser uprights 42, by suitably matching the connecting openings 76, 77 on the connecting legs with connecting openings 82 on the riser uprights, inserting the connecting bolts 84 through registering openings, and securing the bolts by the nuts 86, so that the perpendicular distance between bottoms of the lower slide flanges 34A and 34B, and the bottoms of the corresponding bracket engagement legs 74 equals the perpendicular distance between the upper surfaces of the successive rungs 16A and 16B.

The engagement bolts 90 for the engagement legs 74 are inserted into the mounting openings 80 which are closest to the rear edge of the upper rung 16A when the attachment 10 is mounted. The attachment then may be mounted on the rungs 16A and 16B, by seating the bracket engagement legs 74 on the upper surface of the upper rung 16A, and threading the engagement bolts 88 and 90 through their respective mounting openings 78 and 80, to provide for engagement of the bolts with the rung in the manner illustrated in FIG. 3. The slides 28A and 28B are seated on the upper surface of the lower rung 16B, with the bumper 62 of the abutment 20 abutting on the front edge 26 of the rung. The attachment then is ready for use.

To facilitate tightening the attachment on the ladder, or to adjust its position, the bumper 62, shown in FIGS. 1–4, or the bumpers 136 and 138, shown in FIG. 8, may be augmented by attachment of a spacer or the like to the face of each bumper, at the option of the user. A spacer of suitable form and material may be secured to the relatively soft face of a bumper by screws or other fasteners.

The embodiment of FIG. 6 is mounted on successive rungs of the ladder 102, similarly to mounting the embodiment of FIGS. 1–5. Thus, with the mounting brackets 104 located in suitable positions relative to the riser uprights 42, the engagement legs 106 are seated on a rung 100, and the engagement bolts 88' are threaded through openings in the brackets 104, to project beneath the rung. The slides 28A and 28B are seated on the next successive lower rung, with the bumper 62 of the abutment 20 abutting on the rung.

In order to be able to stand on the platform 24, the user must climb past the platform once mounted on the erected ladder. For this purpose, the platform 24 is moved into its out-of-the-way position, illustrated in FIG. 1, to permit the user to ascend the ladder, with the user's legs moving between the slideways 28A and 28B, followed by stepping on the retracted platform 24 over the lower rung 16B, and then ascending to stand on the upper rung 16A, ordinarily between the brackets 22A and 22B, for the most secure footing. The rounded side corners 40 of the slides prevent injury to the user's legs should the legs contact the corners when moving on the ladder.

In order to place the platform 24 in its working position projecting forwardly from the ladder, the user supports himself by one foot on the upper rung 16A, while lowering the remaining foot to engage the upper surface 110 of the platform 24. This surface preferably is an uneven surface adapted for frictional engagement with the user's free foot, so that the user can move the foot forwardly from the ladder while pressing on the surface, to slide the platform forwardly in the slides 28A and 28B, into a working position such as illustrated in FIG. 2 or FIG. 3.

In the illustrative embodiment, the upper platform surface 124 is provided by an abrasive coating, such as a sand and binder coating, on a platform base of plywood. It will be apparent that other materials of construction may be employed, such as suitable metals, and other uneven or friction-enhanced surfaces might be provided for effective engagement with the foot. As an example, the platform may have a grate-like metal structure, for good engagement with the foot, and such structure also will serve to minimize weight and afford openings for materials to drain or fall through the platform and not collect on it.

With the platform 24 in a working position, the user can stand on it comfortably and work for extended periods of time in a normal stance well supported on both feet. The feet may be supported at a distance forwardly of the upper rung 16A, so that the rung does not interfere with the user's movement and need not come into contact with the user's legs.

When it is desired to descend the ladder, the user may stand on the upper rung 16A on one foot, and use the other foot to slide the platform 24 rearwardly or inwardly of the ladder, by engagement of the foot with the upper surface 142 and/or with the forward edge of the platform. Then, the user can step on the portion of the platform that remains above the lower rung 16B, and step below that rung onto the next lower rung 16C, moving his legs between the slides 28A and 28B.

The attachment 10 may be removed from the ladder, simply by unthreading the engagement bolts 88 and 90 and lifting the brackets 22A and 22B off of the upper rung 16A. Similarly, the brackets 104 are lifted off of the rung 100 of the FIG. 6 embodiment, after unthreading the bolts 88, in order to remove the attachment. The attachment then may be carried down the ladder by the user, or, if desired, may be mounted in the manner described above at a different location on the ladder. If desired, the attachment may be mounted where it will serve conveniently as a support for materials and/or equipment, generally while the user works below the platform.

While preferred embodiments of the invention have been described and illustrated, it will be apparent to those skilled in the art that various changes and modifications may be made therein, within the spirit and scope of the invention. It is intended that all such changes and modifications be included within the scope of the appended claims.

We claim:

1. A platform attachment for a ladder having a pair of spaced apart sidepieces connected together by a series of spaced apart rungs, which comprises:

a pair of spaced apart slideways, means for mounting said slideways on said ladder adjacent to respective ones of said sidepieces, and a platform extending between said slideways and supported thereon for sliding movement reciprocatively between a working position projecting forwardly from the ladder and an out-of-the-way position retracted rearwardly from the working position.

2. An attachment as defined in claim 1 wherein said mounting means comprise a bracket connected to said slideways and engaging a rung of the ladder above the slideways.

3. An attachment as defined in claim 2 wherein said slideways seat on another rung of the ladder.

4. An attachment as defined in claim 3 and including means for connecting said bracket to said slideways adjustably to accommodate differing rung spacings.

5. An attachment as defined in claim 1 wherein said platform is constructed and arranged for engagement by a free foot of a user who is supported by the remaining foot on a rung of the ladder above said slideways, whereby the user can slidably move the platform reciprocatively between said positions with such free foot.

6. An attachment as defined in claim 5 and including an uneven normally upper surface on said platform adapted for frictional engagement with the user's free foot for effecting said movement of the platform.

7. A platform attachment for a ladder having a pair of spaced apart sidepieces connected together by a series of space apart rungs, which comprises:

a pair of spaced apart slideways seating on a first rung of said ladder adjacent to respective ones of said sidepieces, a pair of spaced apart brackets connected to said slideways and engaging a second rung of the ladder adjacent to respective ones of said sidepieces for mounting said slideways on the ladder, said second rung constituting the next successive rung above said first rung, and a platform extending between said slideways and supported thereon for sliding movement reciprocatively between a working position projecting forwardly from the ladder and an out-of-the-way position retracted rearwardly from the working position, said platform being constructed and arranged for engagement by a free foot of a user who is supported by the remaining foot on said second rung, whereby the user can slidably move the platform reciprocatively between said positions with such free foot, the spacing apart of said slideways being such as to permit a user to ascend or descend the ladder with the user's legs moving between the slideways in said pair thereof when said platform is in such out-of-the-way position, and to permit the user to stand with both feet on said platform when it is in said working position, the spacing apart of said brackets being such as to permit a user to stand on said second rung with both feet between the brackets.

8. An attachment as defined in claim 7 and including an abutment connected to said slideways and abutting on a front edge of said first rung therealong, thereby to locate and align the slideways with respect to the ladder.

9. An attachment as defined in claim 7 and including means for connecting said brackets to said slideways adjustably to accommodate differing rung spacings.

10. An attachment as defined in claim 9 and including means for engaging said brackets with said second rung adjustably to accommodate differing rung dimensions.

11. An attachment as defined in claim 7 and including means for connecting together said slideways adjustably to vary the spacing apart of the slideways.

12. An attachment as defined in claim 7 and including means for connecting together said slideways adjustably to vary the spacing apart of the slideways, and means for connecting said brackets to said slideways adjustably to accommodate differing rung spacings.

13. In combination with a ladder having a pair of spaced apart sidepieces connected together by a series of spaced apart rungs, an improved platform attachment which comprises:

a pair of spaced apart slideways, means for mounting said slideways on said ladder adjacent to respective ones of said sidepieces, and a platform extending between said slideways and supported thereon for sliding movement reciprocatively between a working position projecting forwardly from the ladder and an out-of-the-way position retracted rearwardly from the working position.

14. A combination as defined in claim 13 wherein said mounting means comprise a bracket connected to said slideways and engaging a rung of the ladder above the slideways.

15. A combination as defined in claim 14 wherein said slideways seat on another rung of the ladder.

16. In combination with a ladder having a pair of spaced apart sidepieces connected together by a series of spaced apart rungs, an improved platform attachment mountable on any one of a plurality of pairs of successive rungs, which comprises:

a pair of spaced apart slideways seating on a first rung of the ladder adjacent to respective ones of said sidepieces, an abutment connected to said slideways and abutting on a front edge of said first rung therealong, thereby to locate and align the slideways with respect to the ladder, a pair of spaced apart brackets connected to said slideways and engaging a second rung of the ladder adjacent to respective ones of said sidepieces for mounting said slideways on the ladder, said second rung constituting the next successive rung above said first rung, and a platform extending between said slideways and supported thereon for sliding movement reciprocatively between a working position projecting forwardly from the ladder and an out-of-the-way position retracted rearwardly from the working position, said platform being constructed and arranged for engagement by a free foot of a user who is supported by the remaining foot on said second rung, whereby the user can slidably move the platform reciprocatively between said positions with such free foot, the spacing apart of said slideways being such as to permit a user to ascend or descend the ladder with the user's legs moving between the slideways in said pair thereof when said platform is in said out-of-the-way position, and to permit the user to stand with both feet on said platform when it is in said working position, the spacing apart of said brackets being such as to permit a user to stand on said second rung with both feet between the brackets.

17. A combination as defined in claim 16 and including an uneven normally upper surface on said platform adapted for frictional engagement with the user's free foot for effecting said movement of the platform.

* * * * *